United States Patent [19]

Daniluk

[11] 4,339,108

[45] Jul. 13, 1982

[54] ACTUATOR FOR REMOTELY OPERATING A MOVING MECHANISM

[76] Inventor: Philip M. Daniluk, P.O. Box 1391, Edmond, Okla. 73034

[21] Appl. No.: 146,598

[22] Filed: May 5, 1980

[51] Int. Cl.[3] ..... F16K 31/122

[52] U.S. Cl. ..... 251/58; 285/136; 285/190; 92/106

[58] Field of Search ..... 251/58; 285/136, 190; 92/106

[56] References Cited

U.S. PATENT DOCUMENTS

| | | | |
|---|---|---|---|
| 1,851,723 | 3/1932 | Neidow | 285/136 |
| 3,806,082 | 4/1974 | Kellner | 251/58 |
| 4,168,654 | 9/1979 | Willson et al. | 92/106 |
| 4,186,763 | 2/1980 | Ferguson et al. | 285/136 X |
| 4,249,451 | 2/1981 | Le Moal | 92/106 X |

*Primary Examiner*—Arnold Rosenthal

*Attorney, Agent, or Firm*—Kyle W. Rost

[57] ABSTRACT

An annular reservoir is defined by two mutually rotatable annular housing portions having suitable seals and friction reducing members that the housing portions can maintain fluid pressure within the reservoir despite relative rotation between them. Each housing portion is suitably ported for fluid transmission between the reservoir and an external point, such that one member may be connected to an external supply of fluid under pressure and to pressure controls, and the other member may be connected to a fluid powered mechanism such as an hydraulic cylinder, adaptable to perform a mechanical function such as closing or opening a valve. One housing portion may be channel shaped and the other may be receivable within the channel. A side of the channel shaped housing portion is removable to permit assembly and disassembly of the actuator.

19 Claims, 5 Drawing Figures

ACTUATOR FOR REMOTELY OPERATING A MOVING MECHANISM

BACKGROUND OF THE INVENTION

1. Field of the Invention

The invention relates to valves and valve actuation, especially to valve actuators used on blow out preventers. More specifically, the invention relates to fluid actuated or retarded valve operation, wherein the valve is rotating relatively to the actuator or to a portion of the actuator or to a structure connected to the actuator.

2. Description of the Prior Art

In applications wherein a valve is physically rotated, as in combination with another apparatus, a problem is created when it is desired to open or close the valve. Specifically, in oil well drilling rigs a valve is located atop the kelly, also known as the drill string tubing, which is typically a square shaft rotated with the drill bit. This valve is known as the upper kelly valve. At the top of the kelly valve is connected the kelly swivel, which is an attachment point for a hose used to pump drilling mud through the kelly valve, through the kelly, and thus into the well hole to contain the pressures encountered at great depths in the well.

During the drilling of a well if a pressure is encountered that is capable of reverse flowing the drilling mud from the bid upwardly through the kelly and upper kelly valve, a "blowout" may occur, wherein the gases within the well escape. When such pressures successfully escape upwardly through the upper kelly valve, the mud hose may be blown off the swivel, after which a spark may ignite the gases. One purpose of the upper kelly valve is to prevent such a sequence of events from occuring, although this purpose is hindered by the remote location of the upper kelly valve, often forty feet above the ground. In the past most kelly valves have been manually actuated, requiring both that the rotation of the valve be stopped and that a person physically approach the valve before the valve can be closed.

Various devices have been built to remotely close the upper kelly valve, although none are known to have been entirely satisfactory. It is necessary for a remote valve actuator used on an oil drilling rig to be extremely reliable, resistent to dirt and rough handling, and easily adaptable to power sources that are commonly used with such rigs.

The present invention solves these and other problems as is more fully explained below.

SUMMARY OF THE INVENTION

An actuator for remotely operating a moving mechanism includes first and second cooperative reservoir defining means that are rotatable relative to each other, such that the first of said means may be connected to a remote source of fluid and the second of said means may be connected to a fluid powered motive means adapted to translate fluid pressure into mechanical motion and thereby operate an associated mechanism, which may be in motion relative to the first means. Together, the first and second reservoir defining means are able to continuously transmit pressurized fluid via the cooperatively formed reservoir, despite the existance of relative motion between the two defining portions. The first or stationary member is thus equipped with appropriate passageway and connection ports to transmit fluid between the reservoir and a remote source of supply via a control means of known construction; and the second or rotating/rotatable member is equipped with appropriate passageway and connection ports for transmitting pressurized fluid between the reservoir and the motive means, which may be a fluid operated cylinder.

The rotating member may define an annular channel that receives at least a portion of the stationary member to define an annular reservoir at the interface of the two members. Suitable seals and friction reducing means maintain the pressure of the fluid within the reservoir while permitting the two members to have relative motion. Labyrinth seals constructed from low-friction synthetic materials such as Teflon are preferred at the opposite side walls of the channel to both prevent entry of contaminants into the interface area and prevent pressure loss from the reservoir; and additional O-ring or Y-shaped seals may serve as primary and reserve sealing means.

The motive means may be remotely attached to the moving mechanism and connected to the rotating member for receipt of fluid by a flexible conduit, especially when the motive means requires movement relative to the rotating member during operation. The stationary member may be supplementally restrained against rotation with the rotating member by cable, straps, or other restrainers that interconnect the stationary member with an external object to which the stationary member is intended to be substantially stationary.

The primary object of the invention is to create an apparatus capable of controlling moving valves and valve controls, especially upper kelly valve controls on oil drilling rigs, whereby the valve can be closed regardless of whether the drill is in operation.

A further object is to create a remote valve actuator containing a minimum of mechanical mechanism in close association with a moving valve so that there is little chance of equipment failure due to vibration, dirt, and rough handling.

Still another object is to provide a mechanism for remotely closing valves that can be powered by the type of power sources likely to be available via an accumulator, so that the valve can be closed by the reserve pressure in the accumulator even if a motor failure should occur.

DESCRIPTION OF THE PREFERRED EMBODIMENT

Figure 1:
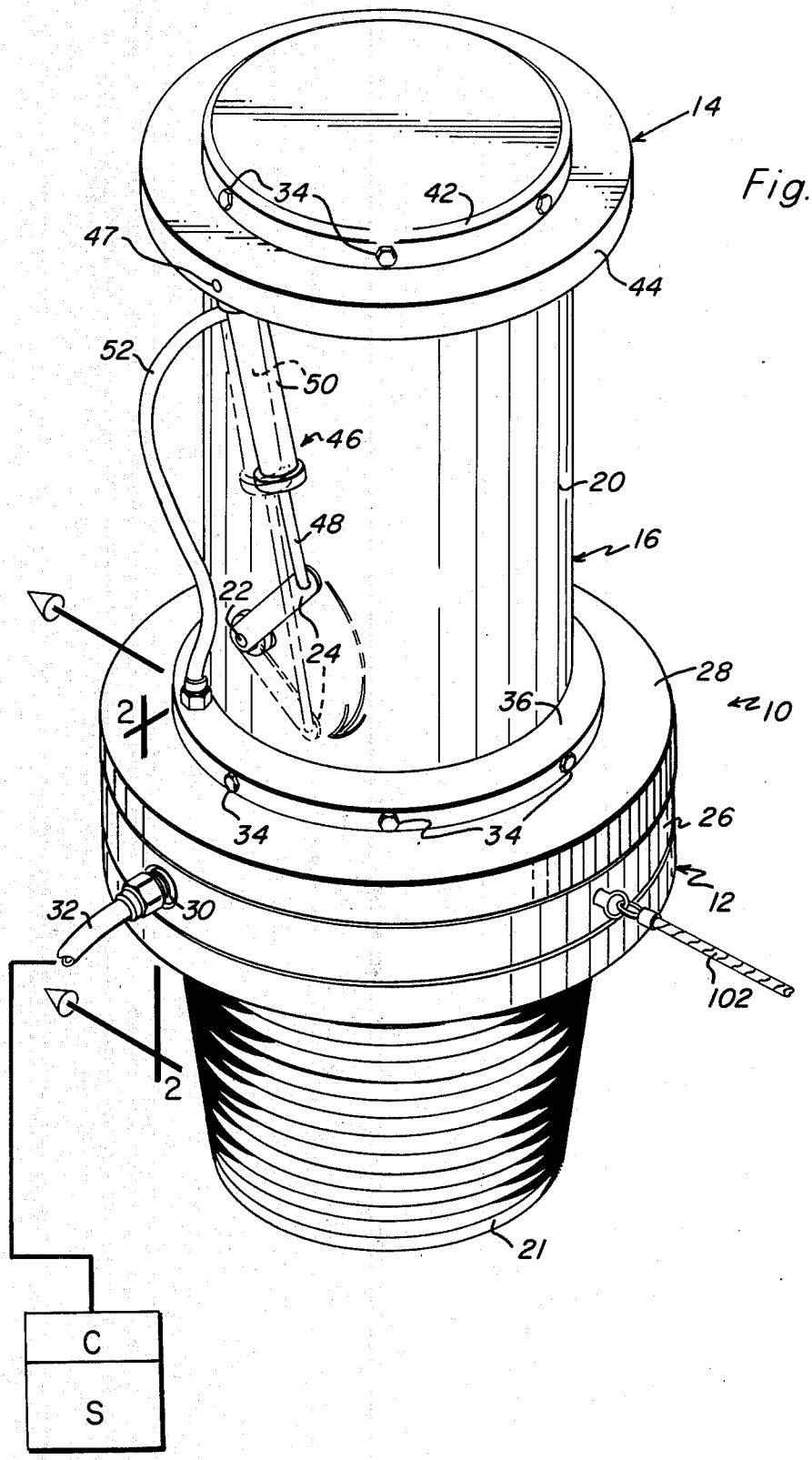
FIG. 1 is a perspective view of the actuator in an embodiment adapted to operation of a kelly valve on an oil drilling rig.

As best shown in FIG. 1, the actuator for remote control of rotating mechanisms is indicated as a whole by the numeral 10. Concentric first and second means for partially defining a fluid reservoir define the main body 12 of the actuator 10, while a motive means may be associated with a secondary body 14 of the actuator. In the useful application of this figure, the actuator has been shown in association with a rotatable mechanism 16, which shares a common axis of rotation with the main and secondary bodies. The main body defines a fluid reservoir 18, FIG. 2, which is at least partially defined by each of the first and second concentric means. In addition, in FIG. 1 the secondary body 14 and one of the concentric means are attached to the rotatable mechanism 16 for rotation therewith, while the other concentric means may rotate relatively to the mechanism 16.

The rotatable mechanism 16 may be defined for purposes of example as an upper kelly valve of the known type used on oil drilling rigs atop the kelly and below the kelly swivel. Such a valve is usually a ball valve and is contained in a cylindrical housing 20 having, according to the arrangement of FIG. 1, a vertical axis of symmetry coincident with the axis of rotation when the drilling rig is operating. At the bottom of the housing is shown an attachment thread 21 suited to connect the kelly valve 16 to the kelly or drill string tubing. The top of the cylindrical housing 20 is adapted to be connected to the kelly swivel in a conventional manner which is therefore not shown. The actuating mechanism for opening or closing a kelly valve is typically a shaft or connecting bolts 34 through secondary body flange 42 into the housing 20. The secondary body includes an annular support ring 44 attached to flange 42 and providing a carrying means for attachment of motive means such as fluid powered cylinder 46. The mounting of the cylinder on the support ring 44 is pivotal, as by hinge pin 47 substantially aligned with a radius of the cylindrical housing 20. Cylinder 46 is of any type capable of transforming fluid pressure into motion, preferably by longitudinally moving cylinder rod 48 with respect to cylinder housing 50. In FIG. 1, the housing 50 is illustrated to be directly connected to the pin 47, while the rod 48 is attached at its extreme end to the arm 24. Longitudinal motion of the rod relative to the housing produces a pivotal motion of the cylinder on pin 47, as shown in phantom in FIG. 1, while also causing a pivotal motion of the arm 24, in turn twisting stem 22. The support ring also carries the cylinder 46 at a sufficient clearance from the kelly valve housing 20 that the cylinder does not strike the housing during the motion between phantom and solid line positions.

The secondary body 14 may be eliminated and its function assumed by the main body 12, but the physical separation of the motive means from the rotating member 28 offers an advantage in permitting a relatively longer flexible conduit 52 to connect the motive means and rotating member, while at the same time extending the conduit 52 away from the possible obstructions of the stationary member. The elongated conduit is then able to reliably flex with the pivotal movement of the or valve stem 22 extending radially from the side of the housing 20 to an outward location where the stem can be twisted about its longitudinal axis through a predetermined arc such as ninety degrees to fully alter the valve condition between open and closed positions. During conventional manual opening or closing of the valve, the stem 22 might be engaged with a wrench to accomplish the desired rotation in the desired direction. However, in FIG. 1 the stem is non-rotatably connected to an arm 24 perpendicular to the longitudinal axis of the stem and serving as a handle lever capable of appropriately twisting the stem 22. Arm 24 may be attached by splines, keyway, welding, socket fit or other connecting device capable of maintaining the non-rotatable relative position between the arm and stem.

The main actuator body 12 includes at least two concentric reservoir defining means that are capable of relative rotation about the concentric axes. At least one reservoir 18 is defined partially by each of the two concentric defining means. Although both defining means may be simultaneously rotating at the same or different speeds in the same or different directions, for application to the kelly valve of FIG. 1 the first concentric defining means may be termed the stationary member 26, and the second concentric defining means may be termed the rotating member 28. The first, stationary member 26 may then be annular in shape and associated with a suitable means for connection to a supply of fluid, for example hydraulic fluid. This connecting means may be port 30 in the outer circumference of the annular stationary member, to which a conventional fluid conduit 32 is attached. The conduit may be connected to any suitable supply S of hydraulic fluid and to any suitable control C for selectively adjusting the pressure of such fluid to the reservoir 18. Drilling rigs are often hydraulically driven and have a ready fluid supply means S in the form of an accumulator. Control means C to draw or feed fluid between the accumulator and the reservoir are well known and readily available, and therefore require no further description.

The second concentric defining means or rotating member 28 may be annular in shape and fixedly attached to the kelly valve housing 20 for rotation about the vertical housing axis with the housing itself as the drilling rig is operated. Attachment may be permanent as by welding, but a removable attachment is preferred as by bolts or like fasteners 34 extending through a flange of the rotating member, for example upper flange 36 of FIG. 1 or lower flange 38 in FIG. 2. Alternatively, the attaching means may be viewed as the inner circumferential wall 40 defining the central opening of the annular rotating member, which may be used for a press fit between the rotating member and the kelly valve housing, or a keyway and key, or splines may be used to achieve the non-rotational relationship to the kelly valve housing.

Regardless of how the non-rotational relationship is achieved between the rotating member 28 and housing 20, the secondary body 14 may then be independently carried by the kelly valve in non-rotational relationship, for example by cylinder when the kelly valve mechanism is to be opened or closed.

Figure 2:
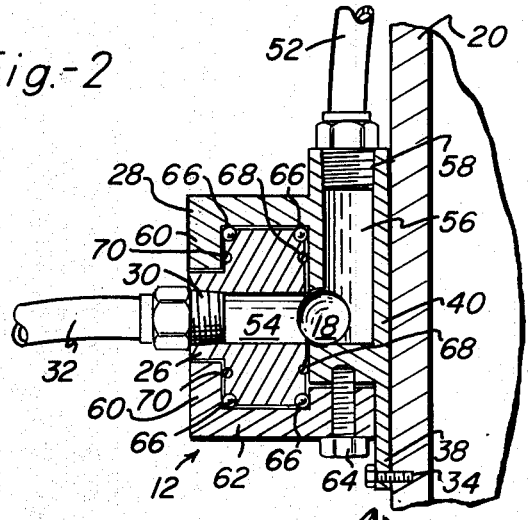
FIG. 2 is a vertical cross-sectional view taken along the plane of line 2—2 of FIG. 1.

With specific reference to FIG. 2, the internal structure of the main body 12 is shown to include an annular reservoir 18 concentric with main body 12 and at least partially defined by the stationary member 26 and rotating member 28. In the stationary member, the fluid connection port 30 is defined in the outer circumferential wall and communicates with the reservoir 18 by a fluid receiving means such as passageway 54 extending from the port to the common reservoir through the radial thickness of the stationary member. The rotating member 28 includes a means for interconnecting the reservoir 18 with the motive means, this feature being illustrated by passageway 56 between the reservoir and a radially extending surface of the rotating member, where a port 58 is defined to receive a coupling member to the motive means. In applications of the actuator 10 wherein the motive means is not required to pivot with respect to the main body 12, the motive means may be directly attached to the rotating member 28, for example at port 58.

The cross-sectional shape of the rotating member 28 is shown in FIG. 2 to be generally that of a U-shaped channel on its side, with the addition of a pair of retaining flanges 60 partially closing the outer circumferential side of the main body. The outer portion of the stationary member containing port 30 is accessible through the gap between the flanges 60 and may constitute an extending portion of the stationary member filling the noted gap area, as shown in the drawings. The radially inner section of the stationary member fits closely within the channel. One side of the channel, shown as bottom wall 62 and including one flange 60, is removable for assembly and disassembly of the actuator and may be held in place by suitable removable fasteners such as bolt 64.

The stationary member is carried within the channel of the rotating member by friction reducing means, and the interface between the two members is closed by seal means. In the embodiment of FIG. 2, bearings 66 are located in suitable positions to prevent substantial surface-to-surface contact between the stationary and rotating members. Such bearings may be located at the inner and outer edges of the channel top and bottom sides. O-ring seals 68 close the interface between the inner circumference of the stationary member and the opposed channel surface and are located between the common reservoir 18 and the first bearings as a primary pressure sealing means. A second set of O-rings 70 seal the interface between the outer face of the stationary member and the flanges 60, serving as a reserve seal means.

Figure 3:
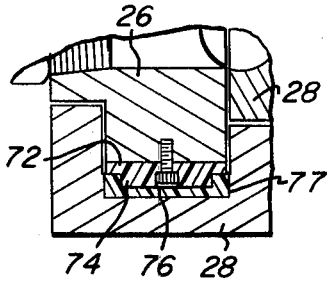
FIG. 3 is an enlarged fragmentary cross-section of a friction reducing means in a modification of the embodiment shown in FIG. 2.

FIG. 3 illustrates an alternative friction reducing means that also increases the pressure and contamination resistance of the actuator. The bearings 66 are replaced by low friction synthetic material pads. Pad 72 joined to the stationary member 26 may have a central rib 74 mating with a central groove 76 in pad 77, which may be joined to the rotating member 28 or freely resting in the channel. Although FIG. 3 illustrates such a pair of mating pads at the bottom of the channel, a pair of pads may also be located at the top of the channel in inverted position. The rib and groove engagement between the pad portions 74 and 76 serves the dual purpose of maintaining the alignment between members 26 and 28 in the radial direction while also providing a labyrinth seal against entry of contaminants from outside the actuator and loss of pressure from the reservoir.

Figure 4:
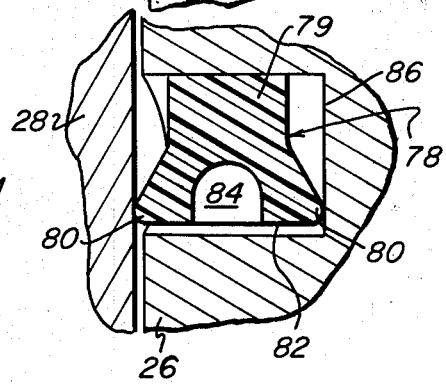
FIG. 4 is an enlarged fragmentary cross-section of a sealing means in a modification of the embodiment shown in FIG. 2.

FIG. 4 illustrates a sealing means that permits the actuator to handle pressures beyond the capability of normal O-ring seals. Seal 78 is of a known type manufactured by Parker Seals of Salt Lake City, Utah. The seal has a base 79, with rectangular or square cross-section and a wedge shaped flange 80 at opposite sides thereof adjacent to a common side 82, which is the pressure-facing side of the seal, thus producing a Y-shaped cross-section. Ordinarily the pressure facing side 82 is fitted with an O-ring in a recess 84 midway between the flanges 80, but for pressure sealing in the actuator 10 this O-ring may be removed. The seal groove 86 is formed in either the stationary member 26 or rotating member 28 and, according to the seal manufacturer's specifications, is substantially square in cross-section and dimensioned to expose only a portion of one flange 80 from the open side of the groove. Pressurized fluid escaping from reservoir 18 along the interface between the stationary and rotating members of the actuator will encounter seal 78 at side 82, and the pressure acts against side 82 and groove 86 to expand the seal base 79 and force the flanges 80 in opposite directions. Pressures as great as five thousand psi can be accomodated in the reservoir 18 through use of seals 78.

Figure 5:
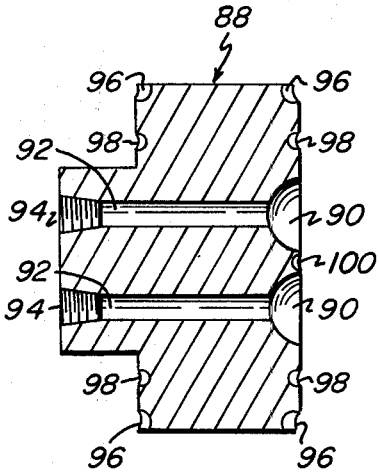
FIG. 5 is vertical cross-section of a modified first reservoir defining means, showing the embodiment containing two reservoirs operable at differential pressures.

A modified first reservoir defining means is shown in FIG. 5 in an embodiment permitting dual direction operation of the motive means. Stationary member 88 includes at least two partial reservoir areas 90 at its inner circumference. Each reservoir area 90 is associated with an independent passageway 92 extending radially outwardly to the outer circumference of the member 88, where each passageway terminates in a port 94. Thus, independent pressures may be maintained in each reservoir 90. The rotating member, not shown in FIG. 5, may have mating reservoir portions and corresponding independent passageways similar to passageway 56 of FIG. 2 for connecting the reservoirs to two sides of a fluid powered cylinder or to two independent cylinders. The rotating mechanism such as kelly valve 16 may then be operated in two directions, as alternatively opened and closed, by the remote operation of a control C alternately supplying pressurized fluid to each of the reservoirs 90 from a common source S; or two unrelated rotating mechanisms may be controlled from a single actuator 10. Although member 88 is shown to have bearing races 96, the synthetic pads of FIG. 3 may be substituted as the friction reducing means. The Y-shaped high pressure seals of FIG. 4 are preferred for use in the seal grooves 98. An additional seal in seal groove 100 between the two reservoirs 90 maintains the supplied pressure differential between the reservoirs.

The actuator 10 therefore provides a fluid reservoir partially defined by a stationary wall ring and partially defined by a rotating wall ring, with suitable closeness between the two rings that the pressure within the reservoir can be maintained while permitting relative rotation between the two rings. The stationary ring provides a communication point for supplying pressurized fluid to the reservoir from a remote source of supply, and the stationary ring's function as at least a partial wall of the reservoir assures that the fluid supply can be in substantially uninterrupted communication with the reservoir. The rotating ring obtains a similar advantage in having substantially uninterrupted communication with the reservoir and thus having the ability to supply pressurized fluid to the motive means on an uninterrupted time basis. Accordingly, in the specific described application of the actuator to an upper kelly valve, the valve can be closed or opened whenever sufficient pressure is available in the accumulator, whether or not the drill is in motion.

The operation of the actuator requires the selective supply of pressurized fluid from source S via control C to the common reservoir in the actuator body. The fluid is transmitted via the stationary member and its contained passageway to the reservoir, and the fluid is further transmitted via the rotating member and its contained passageway to the motive means, where the pressure is translated into motion and acts appropriately to control the rotating mechanism. With reference again to FIG. 1, the arm 24 is moved between two positions approximately ninety degrees apart by the action of cylinder 46 in the direction of the arrow. This motion may be viewed as appropriate to either open or close the kelly valve, the opposite action being required for the opposite function.

Because the tolerances between the stationary and rotating members in the actuator 10 may be quite close, it may be desirable to provide a restraining means to the stationary member so that the fluid supply conduit from source S does not bear the full burden of restraining the stationary member from rotating with the rotating member. A suitable restraining means is a cable 102 attached to the stationary member and also to a stationary structure such as the drill rig superstructure.

While the preferred use of the actuator 10 is as described for the remote closing of upper kelly valves, the same actuator is useful for operating any mechanism wherein the actuator may be concentrically mounted with the mechanism control. Therefore, the disclosure should be understood to be for purposes of example and not limitation.

I claim:

1. A fluid powered actuator for remote control of rotating mechanisms, comprising:

(a) first and second means, each for at least partially defining a common fluid reservoir, wherein the first and second means are joined for relative rotation, the second means including an annular channel-defining housing having an open outer circumference and a circumferential wall opposite from the open side, wherein the circumferential wall partially defines the reservoir, the channel-defining housing further having at least one flange partially closing the open side of the channel and overlapping a portion of the first means, and the first means including an annular ring-shaped body at least partially receivable in the channel in a position overlapped by said flange and having a circumferentially inward face further defining the reservoir in combination with said opposite circumferential wall of the channel-defining housing;

(b) means for attaching said first means, in use, to a supply of fluid;

(c) means for receiving fluid into said common reservoir, in use, from a supply of fluid;

(d) means for attaching said second means, in use, to a fluid powered motive means; and (e) means for conducting fluid, in use, between said common reservoir and motive means.

2. The actuator of claim 1, wherein said ring-shaped body further comprises a radially extending body portion overlapping at least a portion of said flange in the radial direction.

3. The actuator of claim 1, wherein said housing comprises a pair of flanges, one partially closing the open side of the channel on each side thereof.

4. The actuator of claim 1, wherein said channel-defining housing further comprises a removable side wall of said channel and fastening means for removably attaching said side wall to the housing.

5. The actuator of claim 4, wherein said removable channel side wall further comprises a flange partially closing the open outer side of the channel.

6. The actuator of claim 1, wherein said fluid receiving means comprises a passageway in said first partial reservoir defining means communicating with said reservoir and said fluid supply attaching means.

7. The actuator of claim 6, wherein said fluid supply attaching means comprises a port for connection, in use, to an external fluid supply conduit.

8. The actuator of claim 1, wherein said fluid conducting means comprises a passageway in said second partial reservoir defining means communicating with said reservoir and with said motive means attaching means.

9. The actuator of claim 8, wherein said motive means attaching means comprises a port for connection, in use, to an external fluid supply conduit.

10. The actuator of claim 1, further comprising means for attaching said second partial reservoir defining means, in use, to a rotatable carrier.

11. The actuator of claim 10, further comprising fluid powered motive means connected to said second partial reservoir defining means for, in use, controlling a mechanism rotating with the rotatable carrier.

12. The actuator of claim 11, wherein said motive means comprises a fluid powered cylinder.

13. The actuator of claim 1, further comprising restraining means attachable to said first partial reservoir defining means for limiting rotation thereof relative, in use, to the position of a fluid supply source.

14. The actuator of claim 1, further comprising sealing means acting between said first and second partial reservoir defining means for maintaining reservoir fluid against loss.

15. The actuator of claim 1, wherein one of said first and second partial reservoir defining means comprises an annular channel-defining housing and the other of said first and second means comprises an annular ring-shaped body at least partially receivable within the channel, further comprising means for reducing friction between said first and second means during relative rotation of said ring-shaped body in the channel.

16. The actuator of claim 15, wherein said friction reducing means comprises a first pad of synthetic low friction material carried by the ring-shaped body on a surface thereof within said channel and a second pad of synthetic low friction material carried in said channel between the first pad and a channel wall, one of said pads having a rib and the other having a groove in mating relationship.

17. The actuator of claim 1, wherein said first and second partial reservoir defining means define therebetween at least two reservoirs, and further comprising sealing means between the two reservoirs for permitting differential pressure to be maintained there between.

18. A fluid powered actuator for remote control of an upper kelly valve on an oil drilling rig, comprising:

(a) a substantially annular main body adapted to be carried by the upper kelly valve in substantially concentric relationship to the kelly valve axis of rotation, said main body having therein at least one annular fluid reservoir concentric with said main body; wherein the main body comprises a first body portion adapted to remain relatively stationary with respect to the drilling rig and defining an annular portion of the annular reservoir side, said first portion having therein a first passageway connecting the reservoir to an external side of said portion for connecting an external source of fluid pressure to supply fluid to the reservoir; the main body further comprising a second body portion adapted to be attached for rotation with the kelly valve and defining another annular portion of the annular reservoir side, said second portion having a second passageway therein connecting the reservoir to an external side of said second portion for transmitting fluid between the reservoir and, in use, a fluid operated valve control device;

(b) a fluid powered motive means for controlling the kelly valve, said motive means being connected to the second body portion for communication of fluid via said second passageway;

(c) a secondary body adapted to be carried by the upper kelly valve remotely from said main body and for rotation with the kelly valve, said secondary body including a mounting for carrying said motive means; and (d) conduit means interconnecting the main body and the secondary body for transmission for fluid from said second passageway to the motive means.

19. The actuator of claim 18, wherein said mounting is pivotal and said conduit means is flexible.

* * * * *